US006314619B1

(12) United States Patent
Vandergriff

(10) Patent No.: US 6,314,619 B1
(45) Date of Patent: Nov. 13, 2001

(54) MULTIPLE SLOT JET CLEANER AND METHOD

(75) Inventor: Arvel L. Vandergriff, Visalia, CA (US)

(73) Assignee: Vandergriff, Inc., Visalia, CA (US)

( * ) Notice: Subject to any disclaimer, the term of this patent is extended or adjusted under 35 U.S.C. 154(b) by 0 days.

(21) Appl. No.: 09/633,096

(22) Filed: Aug. 4, 2000

Related U.S. Application Data

(60) Provisional application No. 60/147,762, filed on Aug. 6, 1999.

(51) Int. Cl.[7] ..... D01B 1/04

(52) U.S. Cl. ..... 19/48 R; 19/64.5; 19/205

(58) Field of Search ..... 19/48 R, 64.5, 19/65 R, 97.5, 200, 202, 203, 204, 205; 209/139.1, 143

(56) References Cited

U.S. PATENT DOCUMENTS 4,344,843 * 8/1982 Leifeld ..... 209/143
4,365,389 * 12/1982 Beneke et al. ..... 19/200
4,441,994 * 4/1984 Beneke et al. ..... 209/139.1
4,470,172 * 9/1984 Leifeld ..... 19/64.5
4,866,815 * 9/1989 Lucassen et al. ..... 19/205
4,988,373 * 1/1991 Marzoli et al. ..... 209/143
5,365,640 * 11/1994 Sterin ..... 19/200
6,058,567 * 5/2000 Roberson ..... 19/200

* cited by examiner

*Primary Examiner*—John J. Calvert
*Assistant Examiner*—Gary L. Welch
(74) *Attorney, Agent, or Firm*—Richard A. Ryan

(57) ABSTRACT

A multiple slot jet cleaner for removing the small particles of foreign matter that remains with cotton lint after separating the cotton from the seeds and larger foreign matter. The multiple slot jet cleaner uses a series of slots in the wall of a curved conduit used for transporting air having a mixture of cotton and trash. Additional air enters the conduit through the first slot at one of the curves and a portion of the trash exits out the slot due to the turbulence created by the entering air and the effect of the curved conduit. After the slot, some or all of the additional air is removed from the conduit through a discharge opening and then conveyed to a fan where it is delivered to other slots for injection into the conduit to repeat the process for the first slot. In this manner, the operator of the jet cleaner can obtain the benefits of the increased injection of air without the problems associated with handling that air in equipment downstream of the jet cleaner. To improve the efficiency of the jet cleaner, a mechanism for increasing the velocity of the air flow prior to the slots and a mechanism for dispersing the cotton and trash in the air flow prior to the slots are utilized.

20 Claims, 4 Drawing Sheets

MULTIPLE SLOT JET CLEANER AND METHOD

CROSS-REFERENCE TO RELATED APPLICATIONS

This application claims the benefit of U.S. Provisional Application No. 60/147,762, filed Aug. 6, 1999.

BACKGROUND OF THE INVENTION

A. Field of the Invention

The present invention concerns the design and operation of cotton gins. More specifically, the invention is directed towards an apparatus for separating cotton fibers from foreign matter. Even more specifically, the invention discloses an improved apparatus for utilizing high velocity air movement to separate cotton lint from foreign matter.

B. Background

Cotton that is harvested from a field consists primarily of the desired cotton fibers and cotton seed and much undesirable foreign matter, such as burrs, sticks, stems and green leaf material. After harvesting, the cotton/foreign matter material is taken to a cotton gin for processing the harvested material into bulk cotton fibers and cotton seed. A large part of a modern cotton ginning plant consists of machines and processes for separating and removing the foreign matter from the cotton fiber both prior to and following the actual separation of the cotton lint from the seed (the actual ginning). For purposes of background and completeness on cotton ginning, and specifically on the equipment used in cotton ginning plants, the reader is directed to the book "Ginning Cotton—An Entrepreneur's Story" by A. L. Vandergriff, Texas Tech University Press, 1997. This book is incorporated in its entirety herein by the above reference.

The process of extracting foreign matter from the cotton is a multi-stage process, including pre-cleaners such as extractors and cylinder cleaners. Most common extractors make use of cylinders covered with aggressive, hooked teeth. As the cylinders rotate, they engage the cotton fiber/foreign matter mix and drag it over a screening surface. The screening surfaces generally consist of rods or bars mounted laterally adjacent the extractor (toothed) cylinder. Cylinder cleaners, which are generally used after the extractors described above, primarily consist of cylinders having a number of pins protruding from the surface of the cylinder. The cotton is passed between the cylinders and a screen surface, typically inclined forty to forty-five degrees, that is configured to facilitate the falling out of the small particles of foreign material remaining in the cotton stream after treatment by the extractor. To improve the separation efficiency of the cylinder cleaners the use of heated air and deflectors have been incorporated. While the extractors and cylinder cleaners used for the mechanical separation of cotton from foreign matter are generally successful in separating the seed and the larger pieces of foreign material from the cotton lint, they are generally unable to remove small particles of foreign material.

Typically, the last stage of cleaning is to remove the many small trash particles that still remain in the lint after processing by the mechanical devices. A common device for this process is the jet lint cleaner, which utilizes a high volume of air moving at a high rate of speed to separate trash from lint. The prior art jet lint cleaner has been in use for many years and was patented in the 1950s and assigned to the Lummus Cotton Gin Company of Columbus, Ga. A drawing of the process utilized by the jet lint cleaner is set forth in FIG. 1. The lint and trash, commingled together, is conveyed by air created by the gin stand doffing mechanism through the duct identified as "A" in FIG. 1. As the commingled lint and trash approaches the open slot, shown near "C" in FIG. 1, the velocity of the air increases to 5,000 to 7,000 feet per minute due to the decrease in cross-sectional area of duct "A" as it approaches "C". A negative pressure in duct "B" results in an incoming air flow at slot "C". The commingled lint and trash meets the incoming air flow at the open slot at "C". The lint turns into the outgoing duct "B" as the trash particles, having higher density, penetrate the incoming air flow and discharge into the trash chamber by exiting out slot "C".

From the jet cleaner, the cotton lint travels to a condenser where the cotton is pressed into a thin bat to be delivered to a press. The press then "presses" the cotton into a typical 500 pound bale. Samples of the cotton are cut from the bale and sent to the classification office to determine the cotton grade. Cotton grade is determined by analyzing the cotton fiber lengths and the amount of trash remaining in the lint, among other factors.

As would be expected, additional cleaning is beneficial because it can result in a better grade of cotton. In order to obtain the necessary level of clean lint, cotton gin cleaning processes utilize one or more lint cleaners at the end of the ginning process (i.e., after the jet cleaner). The typical lint cleaner has a series of saw blades that cut through the cotton lint to remove the remaining seed and trash from the lint. Unfortunately, the saws in the lint cleaners damages the cotton and has a tendency to merely break the trash into very small particles that are even more difficult to remove. The mechanical cutting action of the lint cleaners tend to lower the grade of the cotton by shredding it into small pieces, thereby damaging the spinning value. This leaves the gin operator with the choice of leaving the small particles of trash in the lint or trying to remove it with the saws in the lint cleaners. Either way, a lower grade of cotton can result, resulting in a lower price for the ginned cotton.

Clearly, it would be beneficial to not rely on the saw action of the lint cleaners to remove the small particles of foreign matter. One way to remove these particles would be to improve the operation of the jet cleaner. Because one slot works well to remove trash particles from lint, it would appear to be desirable to add additional slot systems in series to remove even more trash from the lint. However, this has not been done in the cotton industry due to the volume of air that would be required to be handled by the cleaning system in order to have a multiple slot mechanism. The use of additional volume of air would result in too much pressure build-up and would affect the condensers, which pull air in. In order to supply the additional air that would be needed, the cotton gin would need much larger fans operated by higher horsepower motors, thereby significantly increasing the energy use and cost of the cleaning process. In addition, because the exhaust air from the condensers must be cleaned prior to be discharged to the atmosphere, additional air cleaners (such as cyclone collectors) must be utilized to be able to sufficiently clean the exhaust air in compliance with stringent EPA standards. Naturally, having an increased volume of air to clean results in higher equipment and operating costs.

As a result of the problems associated with lower grade of cotton from small particles of trash in the ginned cotton or the shredding action of the saw blades in the lint cleaners, there exists a need for an apparatus that can effectively and efficiently separate cotton from the small foreign materials that remain after pre-cleaning without harming the value of the cotton.

SUMMARY OF THE INVENTION

The multiple slot jet cleaner of the present invention provides the benefits and solves the problems identified above. Specifically, the present invention discloses an apparatus utilizing a multiple slot system for jet cleaners that does not result in an excessive increase in the volume of air that must be handled by the cotton cleaning system. To accomplish the objective of the present invention, the inventor has developed a cleaning system that skims off some of the air from the duct after passing the slot that allows the air to be reused for injection into other portions of the jet cleaner.

In one embodiment of the present invention, the jet cleaner receives and transports a stream of air having a mixture of cotton and foreign matter into a first conduit having an inlet, an outlet and an exterior wall. The inlet is configured to accept the stream of air from other facilities in the cotton gin and the outlet is configured to discharge the stream of air, consisting of substantially cleaner cotton, to other equipment for further processing. The jet cleaner has two or more air stream processing units, that are in air flow communication with the first conduit, for separating the cotton lint from the trash particles. Each of the processing units has a slot, a second conduit, a discharge opening and a third conduit configured to remove trash particles and to remove air from the jet cleaner system. The slot, located in the exterior wall of the first conduit, is suitable for adding a volume of air from a source of air to the first conduit and for removing a portion of the foreign material in the stream of air into a trash bin or directly into the second conduit, where it is carried away for disposal. The volume of air added is mixed with the initial stream of air to form an enhanced stream of air (having air, cotton lint and trash). The discharge opening removes a portion of the air from the enhanced stream of air into the third conduit to deliver air from the first conduit to the source of air, which can be a fan.

To improve the trash removal efficiency of the jet cleaner, the velocity of the air stream is increased prior to the slot. The velocity can be increased by narrowing the first conduit directly or by placing a restriction inside the first conduit. Further efficiency improvement can be obtained by pressurizing the air flowing through the slot into the first conduit and/or by adding a nozzle that increases the velocity of that flow. The fan can draw a vacuum on the third conduit to facilitate removing air from the first conduit through the discharge opening. In the preferred embodiment, the portion of the air removed from the enhanced stream of air is substantially equal to the volume of air from added through the slot. The preferred embodiment also includes a mechanism for dispersing the cotton and foreign matter in the stream of air prior to the slot to facilitate removal of the foreign matter from the first conduit.

The method of separating cotton from a stream of air having a mixture of cotton and foreign matter utilizing the jet cleaner of the present invention comprises the steps of: (a) transporting the stream of air through the first conduit; (b) adding a volume of air from a source of air into the first conduit through the slot; (c) mixing the volume of air with the stream of air to form an enhanced stream of air; (d) removing a portion of the foreign material from the stream of air into the second conduit through the slot while mixing the volume of air with the stream of air in the first conduit; (e) removing a portion of the air from the enhanced stream of air into a third conduit through the discharge opening; and (f) transporting the portion of air through the third conduit to a mechanism, such as a fan, for circulating the portion of air back to the source of air.

To improve the efficiency of the process of the present invention, the velocity of the stream of air flowing through the first conduit should be increased prior to the step of adding the volume of air into said first conduit and the cotton and foreign matter should be dispersed in the stream of air prior to the step of adding the volume of air through the slot. In the preferred embodiment, the portion of air removed from the enhanced stream of air is substantially equal to the volume of air previously added to the first conduit through the slot.

Accordingly, the primary objective of the present invention is to provide a multiple slot jet cleaner that utilizes flowing air and the weight difference between cotton and the foreign material to separate the cotton fibers from the foreign material.

It is also an important objective of the present invention to provide a multiple slot jet cleaner that utilizes one or more air stream processing units that add air to the cleaner and remove trash from the cotton/trash mixture without increasing the amount of air that has to be handled by the equipment and facilities in the cotton gin downstream of the jet cleaner.

It is also an important objective of the present invention to provide a multiple slot jet cleaner that recirculates air that is removed from an air stream carrying cotton and trash materials by adding the air back into the system and then removing it again so that it does not affect downstream equipment use and sizing.

It is also an important objective of the present invention to provide a multiple slot jet cleaner that improves the removal of trash from a mixture of cotton and trash in an air stream so as to reduce or eliminate the need to rely on saws and other devices, which are harmful to the quality of the cotton, to remove that trash.

It is also an important objective of the present invention to provide a multiple slot jet cleaner that is adaptable to current cotton ginning operations without extensive modifications to the ginning facilities, and is suitable for use with other cotton ginning equipment.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with reference to the embodiment of the present invention illustrated in FIGS. 2 through 6, the preferred embodiment of the present invention, designated generally as 10, is set forth below. The enclosed figures and drawings are merely illustrative of the preferred embodiments and represent several different ways of configuring the present invention. Although specific components, materials, configurations and uses are illustrated, it should be understood that a number of variations to the components and to the configuration of those components described herein and in the accompanying figures can be made without changing the scope and function of the invention set forth herein.

Figure 2:
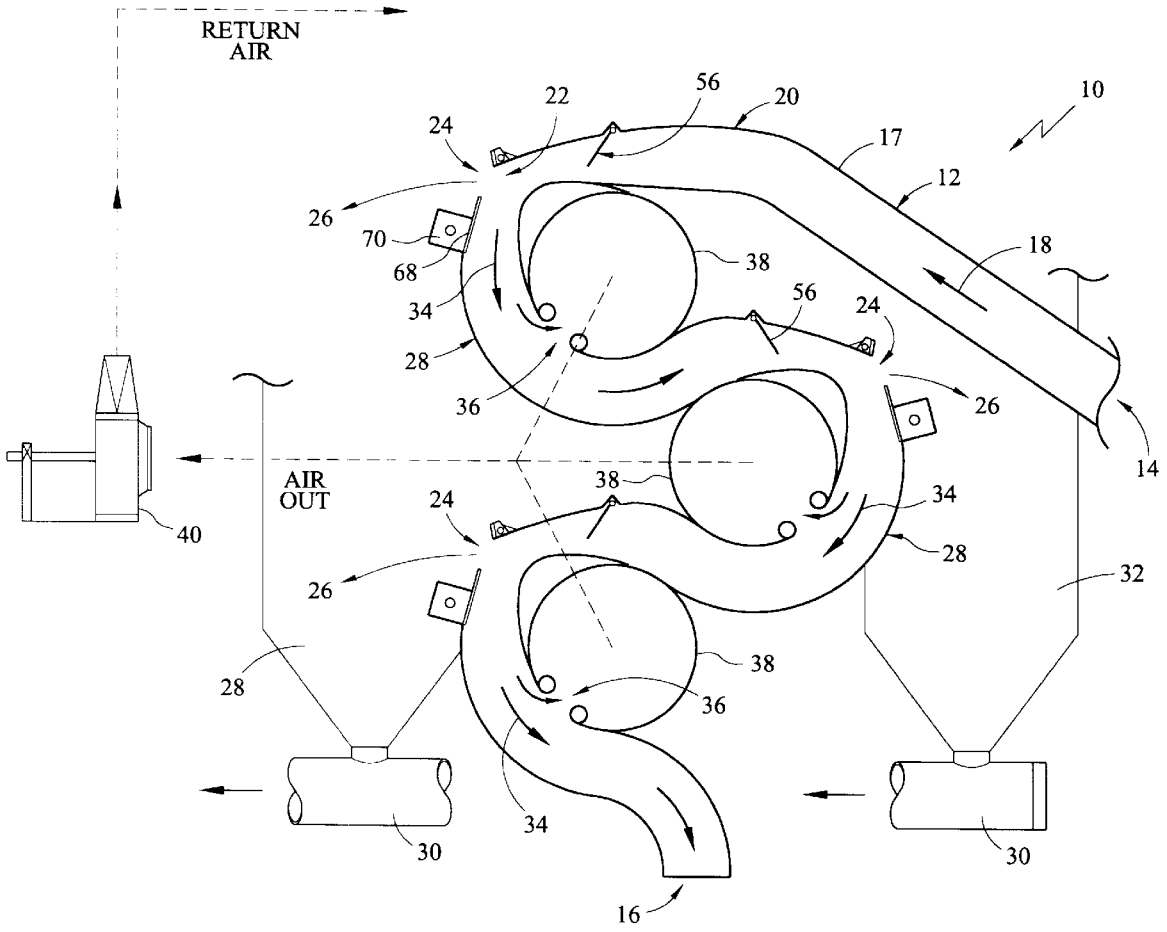
FIG. 2 is a side view of a multiple slot jet cleaner of the present invention.

As shown in FIG. 2, the preferred embodiment of the present invention 10 has a first conduit 12 having an inlet 14, an outlet 16 and an exterior wall 17. Inlet 14 is configured to accept a stream of air, shown as 18, having a mixture of cotton lint and foreign matter (i.e., trash) from the gin stand doffing mechanism, as set forth in the prior art jet cleaners. As is known in the art, first conduit 12 should be suitable for transporting the stream of air 18 having the mixture of cotton and trash therein. Typically the duct work for first conduit 12 has a circular, square or rectangular cross-section and the exterior wall 17 is made out of a lightweight, strong metal, such as stainless steel, tin or the like, although other materials and shapes may also be used for first conduit 12. Outlet 16 connects to and transports the processed cotton lint, with most of the trash removed by the present invention 10, for further processing. Typically, this involves sending the cotton lint to the lint flue, condenser and then to the press.

Figure 1:
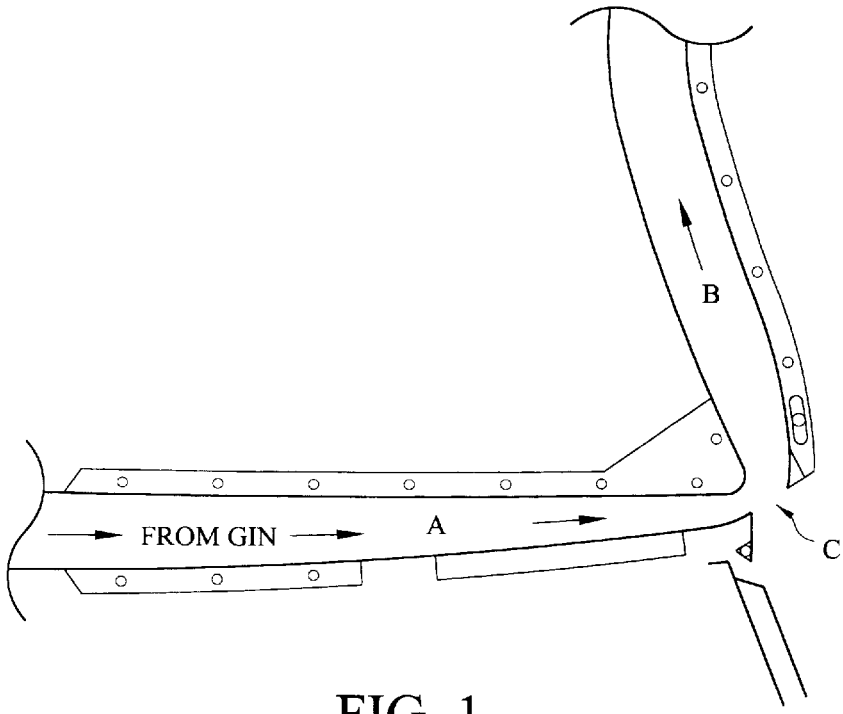
FIG. 1 (PRIOR ART)
FIG. 1 is a side view of a prior art, single slot jet lint cleaner utilized in cotton ginning processes.

As in the prior art jet cleaners, shown in FIG. 1, first conduit 12 includes an area of reduced diameter 20 that is utilized to increase the velocity of the stream of air 18 prior to passing slot 22 located in exterior wall 17. Other mechanisms, such as restrictions placed inside first conduit 12, can be used to increase the velocity of the stream of air 18 prior to slot 22. As in the prior art devices, a volume of air, shown as 24, flows into first conduit 12 through slot 22. If desired, the size and configuration of slot 22 can be adjustable to allow for increasing or decreasing the air flow into first conduit 12. The turbulence from the increase in velocity at 20 and from the mixing with the volume of air 24 coming in through slot 22 causes some of the trash particles, shown as 26, to exit out of first conduit at slot 22 at the bend 28 in first conduit 12. Because the trash particles 26 are heavier than the cotton lint, it will tend to flow with that portion of the stream of air 18 that follows along the straight flow path of first conduit 12 prior to bend 28, while the lighter cotton lint will flow with that portion of the stream of air 18 that continues around bend 28. As is known in the art, slot 22 should be configured to minimize the amount of good lint that is discharged with the trash through slot 22. Trash particles 26 are carried to a second conduit 30 that transports the trash particles 26 away for disposal. In the preferred embodiment, a trash bin 32 collects and funnels the trash particles 26 into second conduit 30. The prior art jet cleaners provide no further processing of the cotton/trash mixture past the bend 28. Unfortunately, much of the trash, particularly that which is lighter weight, remains in the cotton/trash mixture after the heavier trash materials are removed. As discussed above, the prior art devices have been limited due to the amount of air that the jet cleaner systems can handle without a generally unacceptable increase in air flow and handling requirements.

The volume of air 24 entering first conduit 18 through slot 22 mixes with the stream of air 18 originally entering into first conduit 18 to form an enhanced stream of air 34 with a lower amount trash particles (due to that which exited out first conduit 18 at slot 22). Because bend 28 continues around to form a substantially U-shaped configuration, as best shown in FIGS. 1 and 2, the cotton lint and remaining trash in enhanced stream of air 34 is flung against the outer exterior wall 17. Instead of being transported away for final processing, with whatever amount of trash remains mixed in the cotton, the present invention 10 further processes the cotton/trash mixture to remove even more trash than is possible with the prior art jet cleaners. To enable the jet cleaner to remove more trash particles, the present invention 10 includes a discharge opening 36 that opens into a third conduit 38 that acts as an air removal chamber to remove air from first conduit 12. If desired, the outer wall of third conduit 38 can form the inside wall of first conduit 12 at that portion of the jet cleaner 10 which conveys the enhanced stream of air 34 (which is a lint/trash/air mixture) downstream of slot 22. Discharge opening 36 is configured to remove the desired volume of air from the enhanced air stream 34 with minimum amount of lint following the air into third conduit 38. The volume of air to be removed should be such that the increase of air from the volume of air 24 added through slot 22 can be handled by the jet cleaner and its associated equipment (i.e., the condenser unit, etc.).

In the preferred embodiment discharge opening 36 is located approximately 135 degrees downstream from slot 22 and is configured to remove an amount of air approximately equal to the volume of air 24 flowing in through slot 22. In this manner, the overall volume of air being handled by the jet cleaner 10 of the present invention does not increase. Valves in the third conduit 38 can control the volume of air removed through discharge opening 36. Because the cotton lint flows in the air stream against the outer wall of first conduit 12 in bend 28, the cotton will not pass through discharge opening 36. Also in the preferred embodiment, third conduit 38 is under vacuum provided by fan 40, which can be located outside the jet cleaner unit 10. The air from third conduit 38 that is received and then discharged from fan 40 is returned to the jet cleaner 10 into first conduit 18 through the next downstream slot 22. The present invention 10 makes it possible for the duct work and the condenser units downstream of the jet cleaner to be sized to handle only the initial volume of air (i.e., the stream of air 18) from the gin stand, or from any other unit from which the air and lint originate. The flow of air and lint through the unit is aided by approximately 2 to 3 inches of negative pressure created by fan 40 in the downstream condensing unit, or any other mechanism to create the necessary negative pressure.

Figure 3:
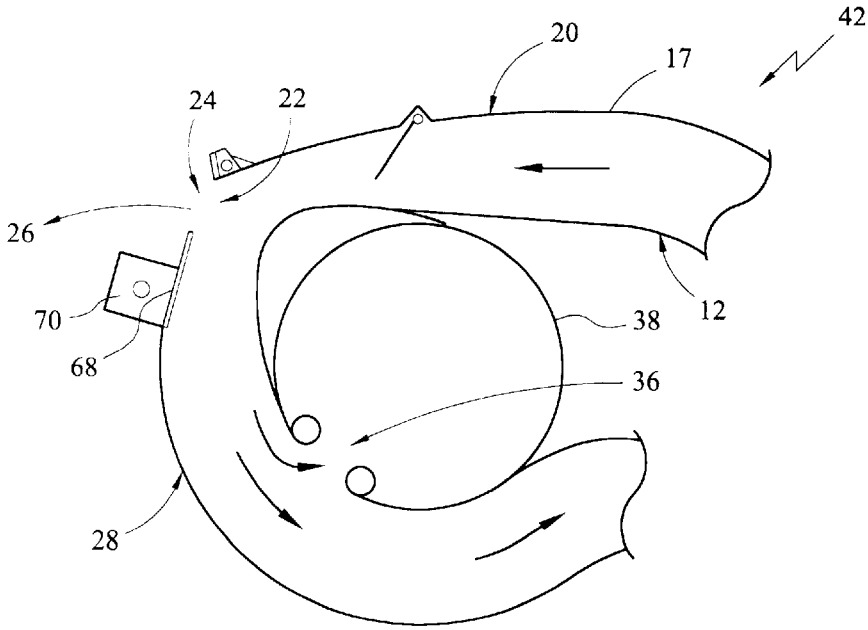
FIG. 3 is a isolated view of an air stream processing unit of the present invention.

As best illustrated in FIG. 3, the combination of velocity increasing mechanism 20, slot 22, discharge opening 36 and third conduit 38 form an air stream processing unit 42 that increases the velocity of air flowing through conduit 12, adds air into the system and removes trash from the cotton/trash mixture through slot 22, removes air from the system through discharge opening 36 and carries away the excess air through third conduit 38. The jet cleaner 10 of the present invention may utilize two or more air stream processing units 42 as needed or beneficial to obtain the desired level of clean cotton lint. Although the number of air stream processing units 42 to be used is a matter of choice (although three are shown in FIG. 2), there may be restrictions to the amount of space available for too many units 42. Most current jet cleaner systems can be modified such that there would be room available for at least three units. Use of the present invention could allow cotton gins to eliminate the need to use lint cleaners (with their cotton damaging saws, referred to as "shredders") after the jet cleaner. This should result in higher grade cotton.

Figure 4:
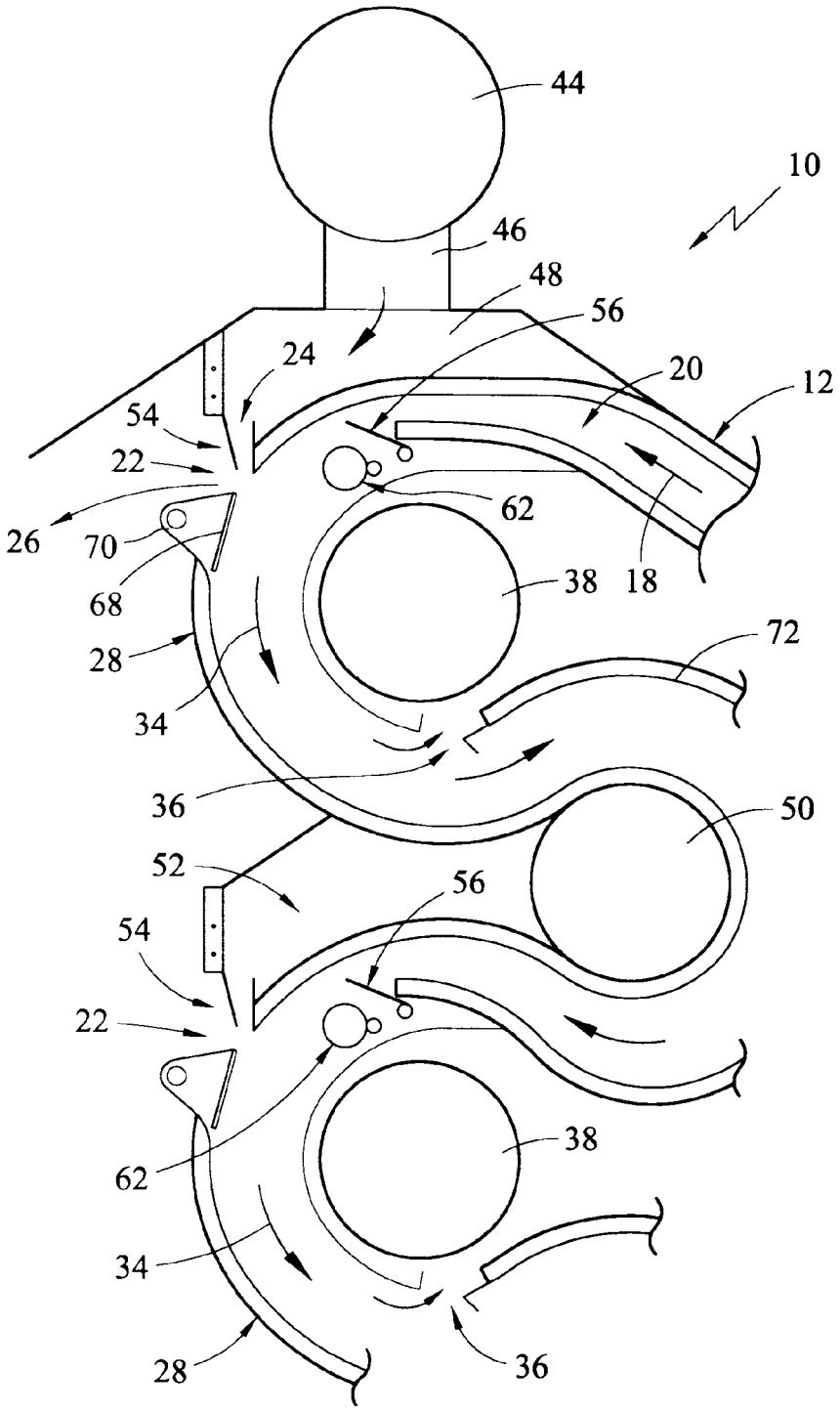
FIG. 4 is a side view of an alternative embodiment of the present invention particularly illustrating the use of a nozzle, dispersing mechanism and throat mechanism.
Figure 5:
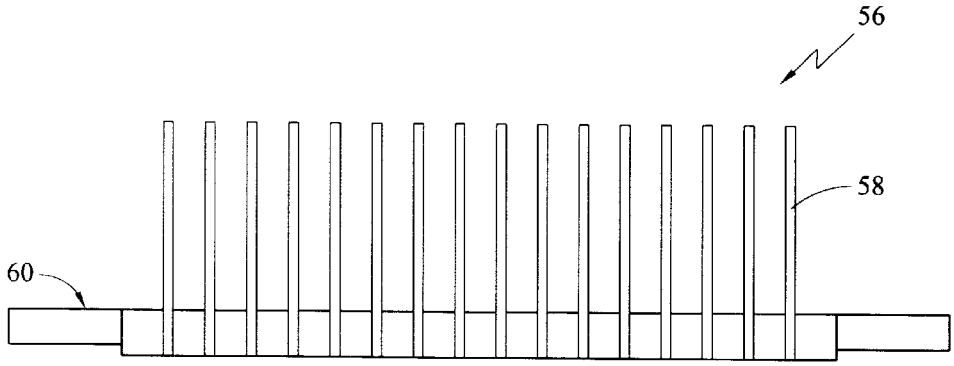
FIG. 5 is a top view of an embodiment of a dispersing mechanism for use with the present invention.

A two unit 42 configuration is illustrated in FIG. 4, which shows the various conduits necessary for the present invention 10 to accomplish its intended effect. The volume of air 24 to be added to first conduit 12 is supplied by first pipe 44 having an outlet 46 connected to first air chamber 48, which is in air flow communication with slot 22 such that air flows from first pipe 44 to first conduit 12 to mix with the stream of air 18 after the velocity increase mechanism 20 (which is an interior restriction in FIG. 4). The enhanced stream of air 34 flows around bend 28 where a portion of the air flow is drawn into third conduit 38 through discharge opening 36 to remove all or a portion of the volume of air 24 added through slot 22. As discussed above, third conduit 38 can be connected to a fan 40 (shown in FIG. 1) that draws air into the conduit 38. The remaining air with cotton/trash mixture flows downstream to the next unit 42, where additional air is added from second pipe 50 into air chamber 52 and through slot 22. The air added from second pipe 50 can be discharged from the fan, which received air via third conduit 38. Once again, trash is removed from the air stream and the enhanced air stream flows downstream of slot 22 to discharge opening 36 where a portion of the air is removed through third conduit 38. This process can be repeated as often as needed to obtain the desired level of clean cotton. In one configuration of the present invention, first pipe 44, second pipe 50 and third conduit 38 can all be 10" diameter pipes.

An alternative method to prevent good lint from escaping through slot 22 is also illustrated in FIG. 4. In this figure, nozzle 54 is placed under positive pressure adjacent to slot 22. The blast of air from nozzle 54 interrupts the lint flow and turns it downstream while allowing the denser particles of trash to continue its travel through slot 22 and to trash chamber 32. In prior art devices, nozzles such as this received its air from the atmosphere and depended on the vacuum in the first conduit 12 to create the nozzle velocity. The present invention allows the user to place nozzle 54 under positive pressure by using the return air from the outside fan 40 that was skimmed off by the discharge opening 36 and third conduit 38. It is believed that this a novel arrangement. Use of nozzle 54, which due to its configuration increases the velocity of the volume of air 24 added to first conduit 12, also reduces the volume of air to be handled by the outside fan 40 in order to obtain the same velocity effect. If desired, the size of the opening exiting nozzle 54 can be adjustable.

To further facilitate the operation of the present invention 10, the preferred embodiment utilizes a dispersing mechanism, identified as 56 in FIGS. 2 through 5, to assist with separating the cotton lint from the undesirable trash. The dispersing mechanism can be a series of rods 58 or other projections that protrude from a shaft 60 to form a comb-like structure (illustrated in FIG. 5). The rods 58 can be replaced with vanes, bars, or other shaped projections or devices as known in the art that can accomplish the same objective of the dispersing mechanism shown in FIG. 5 and set forth below. Shaft 60 is placed inside first conduit 12 such that the rods 58 of dispersing mechanism 56 extend into the high velocity flow inside first conduit 12 upstream of slot 22. The purpose of dispersing mechanism 56 is to pull apart tuffs of lint which may have trash entrained in them. Lint, like any other fibrous material, when conveyed by air around curves or through changes in velocity tend to collect in tuffs due to the varying degrees of turbulence in the air flow. The dispersing mechanism 56 can be adjustable (i.e., to the extent it protrudes into first conduit 12 and the angle at which it does so) so it can project into the airstream at the most effective distance and, as it separates the tuffs, release any trash so that the trash will be free to pass through slot 22. The use of dispersing mechanism 56 has been found to substantially increase the cleaning action of the multiple slot jet cleaner 10 of the present invention.

Figure 6:
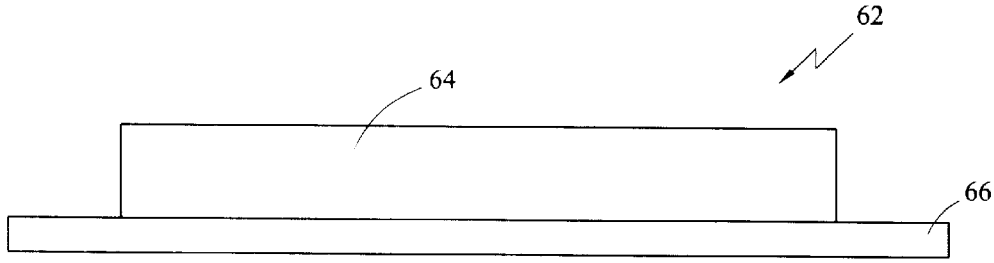
FIG. 6 is a top view of an embodiment of a throat mechanism for use with the present invention.

To further increase the effectiveness of the present invention 10, it can utilize the throat mechanism 62 shown in FIG. 6 to adjust the air velocity through first conduit 12 prior to slot 22. As shown in FIG. 2, the preferred embodiment, first conduit 12 prior to slot 22 reduces in area to increase the velocity past the slot. In an alternative embodiment, shown in FIGS. 4 and 6, the present invention utilizes an adjustable throat mechanism 62. The apparatus shown in FIG. 4 utilizes the throat mechanism 62 from FIG. 6, which can be made up of a 3" outside diameter tube 64 attached to a 1" shaft 66. Other sizes and configurations can also provide the benefits of the mechanism 62 described above. Throat mechanism 62 should be placed inside first conduit 12 just prior to slot 22 so as to restrict the flow of air 18 to increase its velocity. As shown in FIG. 4, the throat mechanism 62 can be placed after dispersing mechanism 56.

For increased flexibility, the present invention 10 can include mechanisms for adjusting the volume and velocity of air going into or out of first conduit 12 through slot 22 or the amount and rate of air being removed from first conduit 12 through discharge opening 36. As shown in FIGS. 2 and 4, slot 22 can include a slidable plate member 68 attached to a control mechanism 70 that allows plate 68 to slide along wall 17 so as to further open or close slot 22 to obtain the desired removal of trash from air stream flow 18. In addition, either side of the opening for nozzle 54 can also move to further open or close nozzle 54 so as to increase or decrease the velocity of air entering first conduit 12 through nozzle 54. Discharge opening 36 can include a slidable portion, shown as 72, that can be selectively slid further into or out of the enhanced air stream 34 to more effectively draw air out of first conduit 12 without removing cotton lint.

In another alternative embodiment of the present invention (not shown), jet cleaner 10 can include one or more air stream processing units 42 that do not remove air from the enhanced air steam 34. For instance, unit 42 in the second position of FIG. 2 can be configured such that discharge opening 36 is closed so that it does not remove air from first conduit 12 when using a three unit system. Not removing air from the second unit allows the air entering slot 22 at the second unit to be added to the volume of air going to the third unit. This arrangement can be used to minimize the complication of having multiple duct work returning air to the slot 22 in the third unit. However, this option is only available if the duct work in and downstream of the jet cleaner 10 can handle the increased volume of air.

In use, the jet cleaner 10 provides a method of separating cotton lint from a stream of air 18 that consists of a mixture of cotton and foreign matter (i.e., trash). The stream of air 18 from the cotton gin is transported through first conduit 12 where a volume of air 24 from a source of air, such as fan 40, is added into first conduit 12 through slot 22 in wall 17 of first conduit 12. In the preferred embodiment, the velocity of the stream of air 18 in first conduit 12 is increased prior where the volume of air 24 is added through slot 22. The volume of air 24 entering through slot 22 is mixed with the stream of air 18 to form an enhanced stream of air 34 in first conduit 12 downstream of slot 22. While the volume of air 24 coming in through slot 22 is mixing with the stream of air 18, a portion of the foreign material from the stream of air 18 exits first conduit 12 to a trash bin 32 then a second conduit 30 through slot 22. Further downstream from slot 22, a discharge opening 36 removes a portion of the air from enhanced stream of air 34 into third conduit 38. The air removed from first conduit 12 through discharge opening is transported through third conduit 38 to a mechanism, such as fan 40, for circulating that portion of air back to the source of air for the volume of air 24. In the preferred embodiment, the cotton and foreign matter in the stream of air 18 is dispersed with a dispersing mechanism prior to adding the volume of air 24 into first conduit 12. In the preferred embodiment, the portion of air removed from the enhanced stream of air 34 is substantially equal to the volume of air 24 previously added to first conduit 12.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A jet cleaner for transporting a stream of air having a mixture of cotton and foreign matter therein and for separating the cotton from the foreign matter, comprising:

a first conduit having an inlet, an outlet and an exterior wall, said first conduit configured to transport the stream of air therein, said inlet configured to accept the stream of air, said outlet configured to discharge the stream of air; and two or more air stream processing units in communication with said first conduit and disposed between said inlet and said outlet, each of said processing units comprising a slot, a second conduit, a discharge opening and a third conduit, said slot located in said exterior wall of said first conduit for receiving a volume of air from a source of air and for removing a portion of the foreign material in the stream of air into said second conduit, said discharge opening in air flow communication with the stream of air in said first conduit for removing a portion of the air from the stream of air, said third conduit interconnecting said discharge opening with said source of air for delivering air from said first conduit to said source of air.

2. The jet cleaner according to claim 1 further comprising a means for increasing the velocity of the stream of air prior to the location of said slot in said wall of said first conduit.

3. The jet cleaner according to claim 1, wherein said source of air is pressurized.

4. The jet cleaner according to claim 1 further comprising a nozzle at said slot for discharging said source of air into said first conduit.

5. The jet cleaner according to claim 1, wherein said source of air comprises a fan, said fan providing a vacuum on said third conduit to draw air from said stream of air.

6. The jet cleaner according to claim 1, wherein said portion of the air removed from said stream of air is substantially equal to said volume of air from said source of air.

7. The jet cleaner according to claim 1, wherein said second conduit is connected to a means for disposing of the foreign material removed from said stream of air through said slot.

8. The jet cleaner according to claim 1 further comprising a means for dispersing the cotton and foreign matter in said stream of air to facilitate removal of the foreign matter from said first conduit, said dispersing means disposed in said first conduit prior to said slot.

9. A jet cleaner for transporting a stream of air having a mixture of cotton and foreign matter therein and for separating the cotton from the foreign matter, comprising:

a first conduit having an inlet, an outlet and an exterior wall, said first conduit configured to transport the stream of air therein, said inlet configured to accept the stream of air, said outlet configured to discharge the stream of air;

two or more slots in said exterior wall of said first conduit, each of said slots located at a bend in said conduit and configured for receiving a volume of air from a source of air into said first conduit and for removing a portion of the foreign material in the stream of air into a second conduit in communication with each of said two or more slots;

two or more discharge openings in air flow communication with the stream of air in said first conduit for removing a portion of the air from the stream of air into a third conduit in communication with each of said two or more discharge openings, each of said two or more discharge openings located downstream of one of said two or more slots; and a suction means in communication with said third conduit for drawing air from said first conduit through said discharge opening.

10. The jet cleaner according to claim 9 further comprising a means for increasing the velocity of the stream of air prior to the location of each of said slots in said wall of said first conduit.

11. The jet cleaner according to claim 9 further comprising a nozzle at said slot for discharging said source of air into said first conduit.

12. The jet cleaner according to claim 11, wherein said portion of the air removed from said stream of air is substantially equal to said volume of air from said source of air.

13. The jet cleaner according to claim 9, wherein said vacuum means discharges said volume of air into said source of air.

14. The jet cleaner according to claim 9, wherein said portion of the air removed from said stream of air is substantially equal to said volume of air from said source of air.

15. The jet cleaner according to claim 9, wherein said second conduit is connected to a means for disposing of the foreign material removed from said stream of air through said slot.

16. The jet cleaner according to claim 9 further comprising a means for dispersing the cotton and foreign matter in said stream of air to facilitate removal of the foreign matter from said first conduit, said dispersing means disposed in said first conduit prior to said slot.

17. A method of separating cotton from a stream of air having a mixture of cotton and foreign matter therein, comprising the steps of:

transporting the stream of air through a first conduit having an inlet, an outlet and an exterior wall;

adding a volume of air from a source of air into said first conduit through a slot in said exterior wall of said first conduit;

mixing said volume of air with said stream of air to form an enhanced stream of air in said first conduit;

removing a portion of the foreign material from the stream of air into a second conduit through said slot while mixing said volume of air in said first conduit;

removing a portion of the air from said enhanced stream of air into a third conduit through a discharge opening in said exterior wall of said first conduit; and transporting said portion of the air through said third conduit to a means for circulating said portion of air back to said source of air.

18. The method according to claim 17 further comprising the step of increasing the velocity of the stream of air prior to the step of adding said volume of air into said first conduit.

19. The method according to claim 17 further comprising the step of dispersing the cotton and foreign matter in the stream of air prior to the step of adding said volume of air into said first conduit.

20. The method according to claim 17, wherein said portion of air removed from said enhanced stream of air is substantially equal to said volume of air previously added to said first conduit.

* * * * *